US009607507B1

(12) United States Patent
McClintock et al.

(10) Patent No.: US 9,607,507 B1
(45) Date of Patent: Mar. 28, 2017

(54) USER ACTIVITY-BASED ACTIONS

(71) Applicant: AMAZON TECHNOLOGIES, INC., Reno, NV (US)

(72) Inventors: Jon Arron McClintock, Seattle, WA (US); Darren Ernest Canavor, Redmond, WA (US)

(73) Assignee: AMAZON TECHNOLOGIES, INC., Reno, NV (US)

( * ) Notice: Subject to any disclaimer, the term of this patent is extended or adjusted under 35 U.S.C. 154(b) by 162 days.

(21) Appl. No.: 14/314,437

(22) Filed: Jun. 25, 2014

(51) Int. Cl.
*G08C 17/04* (2006.01)

(52) U.S. Cl.
CPC ..... *G08C 17/04* (2013.01)

(58) Field of Classification Search
CPC ..... G08C 17/04; G08C 17/02; G08C 17/00; G06F 15/00; G06F 19/3418; G06F 11/2294; G06F 11/3495; G06F 17/40; G06F 19/00; G06F 19/3406; G06F 19/3412; G06F 19/3468; G06F 19/3481; G08B 21/02; G08B 21/12; H04Q 9/00; G01R 11/00; G01F 23/36; G01D 4/002; A61B 5/0002
See application file for complete search history.

(56) References Cited

U.S. PATENT DOCUMENTS

2013/0197976 A1* 8/2013 Mahakian ..... G06Q 10/08 705/7.38
2014/0070959 A1* 3/2014 Bhargava ..... H04Q 9/00 340/870.07
2014/0247152 A1* 9/2014 Proud ..... H02J 7/025 340/870.07
2014/0248852 A1* 9/2014 Raleigh ..... H04M 15/723 455/407
2014/0343946 A1* 11/2014 Torok ..... G10L 15/30 704/270.1
2015/0020086 A1* 1/2015 Chen ..... H04N 21/44218 725/12
2015/0112796 A1* 4/2015 Greenzeiger ..... G06Q 30/0251 705/14.49
2015/0237412 A1* 8/2015 Shimy ..... H04N 21/812 725/12
2015/0288773 A1* 10/2015 Fujii ..... G06Q 20/322 705/39
2015/0330652 A1* 11/2015 Kim ..... F24F 11/006 700/276

(Continued)

*Primary Examiner* — Hirdepal Singh
(74) *Attorney, Agent, or Firm* — Lindauer Law, PLLC

(57) ABSTRACT

Described are techniques and systems for determining a state of activity of a user, and performing operations responsive to the state. The state may be determined using environmental data and operational data. The environmental data provides data indicative of the user's level of activity and may include data from sensors such as cameras, microphones, motion sensors, and so forth. The operational data includes data about performance of one or more services which may be associated with the user. The state may indicate that the user is resting, awake, working, exercising, and so forth. For example, while the user is inactive, such as while resting, resource-intensive operations may be performed. By determining when the user is inactive and detecting unusual levels of activity by the service problems such as damage to the service or malicious activity may be identified.

20 Claims, 9 Drawing Sheets

(56) References Cited

U.S. PATENT DOCUMENTS

| | | | | |
|---|---|---|---|---|
| 2015/0372832 | A1* | 12/2015 | Kortz | G05B 15/02<br>700/278 |
| 2016/0063828 | A1* | 3/2016 | Moussette | G08B 6/00<br>340/540 |

* cited by examiner

USER ACTIVITY-BASED ACTIONS

BACKGROUND

Within one or more facilities such as a home or office, a user may experience different levels of activity over a period of time such as a day. For example, users may be asleep, awaken, work or go about their daily business, exercise, relax, and then go to sleep again. During the course of their day, users may take advantage of a wide variety of services ranging from civil utilities to data processing. For example, during the morning users may be using municipal water utility and energy to heat water, may use data bandwidth to watch television news during breakfast, and so forth. Benefits may accrue from coordinating the activities of different services with respect to the activity of the users.

BRIEF DESCRIPTION OF FIGURES

The detailed description is set forth with reference to the accompanying figures. In the figures, the left-most digit(s) of a reference number identifies the figure in which the reference number first appears. The use of the same reference numbers in different figures indicates similar or identical items or features.

Figure 1:
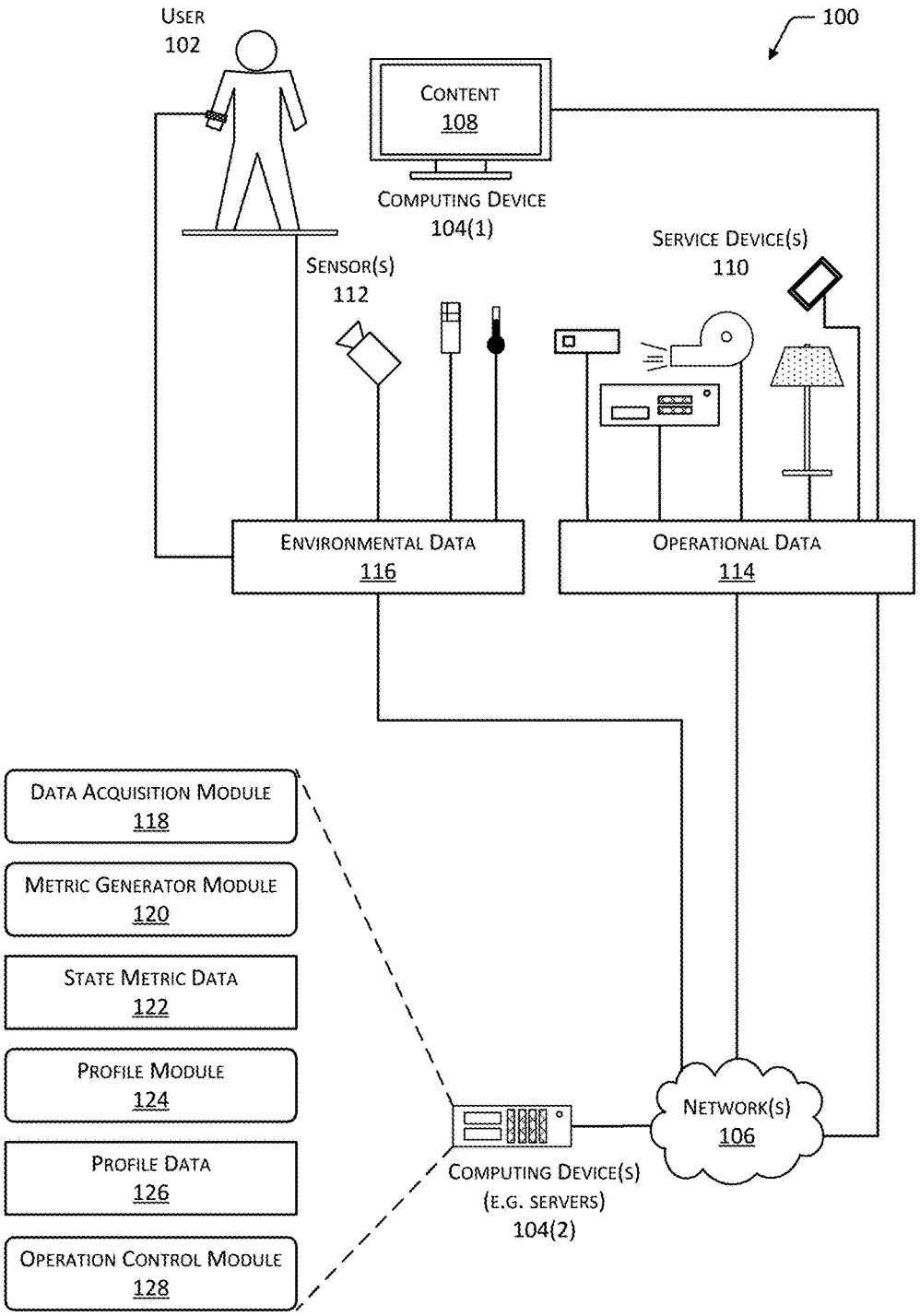
FIG. 1 is an illustrative system for determining activity of one or more users and one or more services, and controlling operation of the one or more services.

While implementations are described herein by way of example, those skilled in the art will recognize that the implementations are not limited to the examples or figures described. It should be understood that the figures and detailed description thereto are not intended to limit implementations to the particular form disclosed but, on the contrary, the intention is to cover all modifications, equivalents, and alternatives falling within the spirit and scope as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION

During the course of the day, a user may experience a variety of different levels of activity or inactivity. For example, the user's day may begin in an inactive state such as sleeping and transition to an active state such as working. Different levels of activity or inactivity may be distinguished. For example, the user may be highly active while exercising vigorously or while working, and may be lightly active while watching a television show. Thus, throughout the day, the user may experience a level of activity which exists within a continuum between a very high level of activity and a very low level of inactivity.

To support or otherwise provide a benefit to the user, one or more services associated with the user may be utilized. The services may include civil utilities, communications, data processing, delivery of goods, performance of a professional service, and so forth. For example, the civil utilities may include water, sewer, electricity, gas, public transportation, and so forth. In another example, the data processing may include retrieving data from a remote computing device such as content for work or entertainment, or sending data for processing by the remote computing device. In yet another example, the service associated with the user may be delivery of a parcel by way of a deliveryman or an autonomous vehicle.

Some services are best performed or delivered when the user manifests a particular level of activity. For example, the user may not wish to have parcels delivered while they are sleeping, have a transfer of a large amount of data to a remote computing device take place while they are active and in contention for network bandwidth, and so forth. Thus, it may be desirable to perform operations or otherwise control one or more services based at least in part on degree of activity manifested by the user.

The systems and techniques described in this disclosure may determine one or more of activity of the user, activity of the service, or an aggregate activity of the user and service. As used in this application, activity may be indicative of an intensity of operation, quantity of output, indicia of motion, and so forth. For example, the user may be deemed active while composing computer code but have a relatively low level of contemporaneous physical activity. The user may also be deemed active while exercising but not necessarily performing contemporaneously any substantive mental tasks.

A metric generator may generate state metrics indicative of a level of activity of the user. The level of activity of the user may be relative to historical data, a baseline, and so forth. The information for the baseline or historical data may be acquired from the user himself, or may be acquired from other users or an aggregation of other users. To determine activity level, a numeric score or value may be associated with particular parameters. For example, a frequency and velocity of motion may be measured and used to generate a numeric score indicative of physical activity.

The metric generator may generate state metrics indicative of a level of activity of one or more services. The services may be associated with the user, such as the civil utilities at the home of the user, or data processing services using a billing account tied to the user. The metrics may be based on information such as network traffic analysis, number of input output operations, processing cycles used, quantity of energy consumed, quantity of water consumed, and so forth. For example, level of activity from a home automation system may be based on a number of lights which are currently active in a home and an intensity level of the illumination. In another example, the level of activity may be based on log data from a computing device indicating the computing device is operating at 99% of processing capacity.

The metric generator may use operational data, environmental data, or both to generate state metric data. The operational data comprises information which has been acquired from one or more service devices. The service devices may include computing devices, utility monitoring or control systems, heating ventilation and air conditioning (HVAC) systems, household appliances, home automation systems, security systems, and so forth. The operational data may be indicative of the operation, status, and so forth of the service devices. For example, the operational data may indicate that a particular user is logged into a particular computing device, utilizing a particular data processing service, that a load of laundry is being washed in the washing machine, the refrigerator door is open, and so forth.

In comparison, the environmental data provides data indicative of the physical environment in which the user may be present. The environmental data is acquired from one or more sensors. The sensors may include cameras, 3-D sensors, microphones, biomedical sensors, and so forth. For example, the environmental data may provide information indicative of how much movement the user is making during a given period of time, whether the user's eyes are open, that the user is physically present at a particular location, and so forth. The sensors may be mounted in the facility, may be carried or worn by the user, and so forth. For example, the sensors may include accelerometers or other motion sensors which are worn on a wristband of the user or which are incorporated into a smart phone or tablet which the user carries with them.

The state metric data may be generated using one or more of the operational data or the environmental data. For example, the state metric data which indicates activity level of the user may be based on environmental data such as the user's eyes are open and operational data indicating the user is actively inputting data into a word processor. As a result, the state metric data may indicate that the user is deemed to be highly active while sitting in front of a computing device.

The state metric data provided by the metric generator may be used to generate profile data. In one implementation, the profile data may comprise a time series of state metric data indicating changes in scores indicative of activity level over time. The scores may be generated using one or more of: the operational data indicative of operation of the service devices and their corresponding services, environmental data indicative of activity of the user, or both in an aggregate score. By comparing current state metric data with previously determined profile data, the current state metric may be categorized as exhibiting a particular activity level, such as active or inactive. Furthermore, comparisons may be made to detect an activity level which is anomalous.

Unlike traditional systems which use only a preset time window to perform particular actions, the techniques described herein are responsive to the dynamically changing circumstances of the user. For example, instead of a water softener engaging in a regeneration cycle every morning at 4:00 AM, the regeneration cycle may instead be initiated while the user is taking a daytime nap. As a result of using the techniques described in this disclosure, the service may be performed more efficiently, in a less obtrusive way, and more effectively, improving the user experience.

By being responsive to the level of activity of the user, other functionalities may also be provided to the user. For example, the user may fall asleep while consuming rented content such as a movie streamed to a computing device such as a television or set-top box. To conserve network bandwidth, transmission of the streamed content may be discontinued until the user becomes more active. Additionally, a rental period of the content may be extended at no charge or a reduced charge because the user was asleep.

Furthermore, by comparing the activity level of the user with the activity level of a service, anomalous performance of the service may be determined. For example, while the user is napping during the day (thus manifesting a very low level of activity), the user's demands for the functions of a service such as data processing are reduced. Should a data processing service or communication service experience a level of activity which exceeds a threshold, anomalous activity is determined and may result in one or more operations such as generating an alarm to notify the user, terminating or otherwise disabling the service, initiating detailed logging which may be suitable for forensic use, and so forth. As a result, the system may be able to detect malicious activity such as botnets, data theft, and so forth which may otherwise evade detection.

Illustrative System

FIG. 1 is a system 100 for determining activity of one or more users and one or more services and controlling operation of the one or more services based on the level of the activity. One or more users 102 may be present at a facility such as a dwelling, office, factory, and so forth. In some implementations, the facility may include a vehicle, such as an aircraft, automobile, and so forth.

One or more computing devices 104(1), 104(2), . . . , 104(D) may provide or control one or more services to, or in support of, the user 102. The computing devices 104 may include televisions, tablet computers, personal computers, electronic book readers, gaming consoles, set-top boxes, media players, in-vehicle entertainment systems, smartphones, servers, device control systems, and so forth. As used in this disclosure, letters in parenthesis such as "(D)" indicate an integer value.

The computing devices 104(1), 104(2), . . . , 104(D) may couple to one or more networks 106. The networks 106 may include public networks, private networks, or a combination thereof. The networks 106 may include, but are not limited to personal area networks (PANs), local area networks (LANs), wide area networks (WANs), and so forth. The networks 106 may communicate using Ethernet, Wi-Fi®, Bluetooth®, ZigBee®, 3G, 4G, or other technologies.

In some implementations, the computing device 104(1) may be configured to present content 108. The content 108 may comprise audio, video, music, audiobooks, applications, and so forth. For example, when the computing device 104(1) comprises a set-top box, the computing device 104 (1) may be used to present the content 108 which is provided by way of the network 106 from a server computing device 104(2).

The system 100 may include one or more service devices 110 and one or more sensors 112. The service devices 110 may include the computing devices 104(1), 104(2), . . . , 104(D), utility monitoring or control systems, heating ventilation and air conditioning (HVAC) systems, household appliances, home automation systems, security systems, irrigation control systems, exercise equipment, and so forth. For example, the service devices 110 may include a router for the network 106, room lights which are part of a pervasive network of interconnected devices that are uniquely identifiable also known as an Internet of Things (IOT), and so forth. The service devices 110 may be locally present within a facility or may be at another location. For example, the household appliances may be local to the user's 102 home, while the computing device 104(2), such as a server running a parcel delivery dispatch system, may be located remotely and accessible by way of the network 106.

The service devices 110 are configured to provide or support the provisioning of a service for the user 102, or in support of the user 102. In some implementations, the service may involve the transport, delivery, or processing of a good or commodity. For example, the service devices 110 may include the parcel delivery dispatch system mentioned above, delivery trucks themselves, autonomous vehicles, or other mechanisms used to deliver a good to the user 102.

In some implementations, the service devices 110 may include or have access to sensors 112 which may provide information about the performance of the service devices 110, the interaction of that service device 110 (or a subsidiary component) with the surrounding environment, or other service devices 110. For example, where the service device 110 comprises a refrigerator, a switch may be used to detect that the door of the refrigerator is open.

The service devices 110 may be configured to provide operational data 114. The operational data 114 provides information indicative of the operation, status, and so forth of the service device 110. For example, the operational data 114 may comprise information about processor loading, memory availability, currently executing processes, and so forth of the computing device 104(1). In another example, the operational data 114 may comprise information from a home automation system indicative of which lights in a home are active and the intensity level of those lights. In yet another example, the operational data 114 may comprise information from a security system indicating times and identification of doors or windows which have been opened and closed. The operational data 114 may comprise information which is solely indicative of operation of the service device 110, or may also include information indicative of how the user 102 is interacting with the service device 110. For example, the operational data 114 may comprise information indicating that the user 102 has logged into the television computing device 104(1), is using the network 106 to transfer data with a remote computing device 104(2), has opened the refrigerator door, and so forth.

The operational data 114 may include information indicative of the type of service. For example, types of service may specify data processing, physical delivery, utility delivery, transportation, and so forth. Similarly, the operational data 114 may include information indicative of a type of device providing the service. For example, the operational data 114 may distinguish that the content 108 is presented on a smart phone or a television. One or more of a start time of use of the service, duration of use of the service, end time of use of the service, and so forth may also be included in the operational data 114. Operational data 114 associated with the computing device 104(1), 104(2), . . . , 104(D) may include information such as data transfer rate with regard to the network 106, number of processor cycles used, number of input/output operations, memory used, and so forth.

The sensors 112 generate environmental data 116. The sensors 112 may be located at different points within the facility, may be carried by the user 102, worn by the user 102, implanted within the user 102, or a combination thereof. For example, the sensors 112 may be mounted on the walls or furniture of the facility. In another example, the sensors 112 may be part of an implanted medical device such as a pacemaker or insulin pump. The sensors 112 provide information about the user 102 and how they are interacting with or present in the environment of the facility. For example, the sensors 112 may provide information about the presence of the user 102 in the facility, location of the user 102 within the facility, pose of the user 102, or activity of the user 102. The pose of the user 102 may include the physical configuration of one or more body parts in relation to one another or an object in the facility. The pose of the user 102 may include whether the user's 102 eyes are open or closed, overall orientation of the user's 102 body such as whether standing, sitting, lying down, and so forth. The activity of the user 102 provides information indicative of an extent or nature of physical movement of one or more limbs, torso, head, and so forth. Activities of the user 102 may include the user 102 moving about such as walking, the user 102 speaking, or the user 102 performing one or more tasks with the computing device 104(1), 104(2), . . . , 104(D) such as typing on a keyboard, using a touch sensor, watching a display device, and so forth. Other environment data 116 may include a count of a number of users 102 present at the facility or a portion thereof. For example, the environment data 116 may indicate that six users 102(1)-(6) are present in the living room of a dwelling. In some implementations, actual or approximate ages of the users 102 may be determined. For example, an analysis of images of the users 102 may be used to generate an approximate age of the users 102, estimate gender, and so forth.

The sensors 112 may include cameras, microphones, weight sensors, and so forth. The sensors 112 are discussed in more detail below with regard to FIG. 2. The environmental data 116 comprises information resulting from the sensors 112. For example, where the sensor 112 comprises a camera, the environmental data 116 may comprise image data from the camera.

A server or other computing device 104(2) is coupled to the network 106 and is in communication with one or more of the other computing devices 104(1), . . . , 104(D), the service devices 110, the sensors 112, and so forth. The server may comprise one or more physical computing devices, virtual computing devices, or utilize a combination thereof. The server or other computing device 104(2) may include one or more modules and data including but not limited to: a data acquisition module 118, a metric generator module 120, state metric data 122, a profile module 124, profile data 126, or an operation control module 128.

The data acquisition module 118 is configured to acquire the operational data 114, the environmental data 116, or both. The data acquisition module 118 may be configured to accept data as "pushed", or may be configured to "pull" data from the service devices 110, sensors 112, or other devices. In some implementations, the data acquisition module 118 may perform filtering, preprocessing, or other data preparation or analytics. For example, the data acquisition module 118 may be configured to process image data and provide user identification based on facial characteristics. In another example, the data acquisition module 118 may be configured to process audio data from a microphone to categorize sounds as speech, laughter, snoring, and so forth.

The metric generator module 120 is configured to use the operational data 114, environmental data 116, or both to generate state metric data 122. The state metric data 122 may comprise a score or numeric value which is indicative of a level or type of activity as performed by the user 102, the service device 110, or a combination thereof.

The metric generator module 120 utilizes one or more techniques to generate the state metric data 122. These techniques may be based at least in part on the type of data. For example, the metric generator module 120 may receive accelerometer data from a sensor 112 worn by the user 102. The accelerometer data may provide information indicative of the movements of the user 102. For each movement of the user 102 which exceeds a threshold acceleration and duration, a counter may be incremented. As a result, the metric generator module 120 may process the accelerometer data and generate user state metric data 122 comprising a numeric value which indicates how much the user 102 is moving. Continuing the example, the inactive user 102 who is a sleeping user 102 may exhibit a value of 27 while the same user 102 exercising may exhibit a value of 397. In some implementations, the score may be normalized or other data processing operations performed.

The metric generator module 120 may use image processing techniques to generate the state metric data 122. For example, where the environmental data 116 comprises image data from one or more cameras, the metric generator module 120 may perform object recognition to identify an object or person, may detect and characterize motion between a plurality of images, and so forth.

The metric generator module 120 may generate state metric data 122 based at least in part on historical data. Historical data may comprise information such as operational data 114, environmental data 116, or both which have been acquired previously. For example, the historical data may be acquired over the previous hour, day, week, month, year, and so forth. In some implementations, the metric generator module 120 may generate particular scores associated with particular sensors 112, and service devices 110. For example, an environmental score may be generated based on the environment data 116, while an operational score may be generated based on the operational data 114.

The metric generator module 120 may generate state metric data 122 which is segregated into one or more categories of activity, such as "active" or "inactive". In some implementations, the segregation may be performed based on a comparison of a score with a previously determined value, by looking at a change in score per unit time, and so forth. For example, an activity having an environmental score which is below a threshold value may be deemed to be inactive while an activity having environmental score which is above the threshold value may be deemed to be active.

The metric generator module 120 may generate current state metric data 122. The current state metric data 122 may be indicative of the state of the user 102 as determined by the sensors 112, the service devices 110, or both, within a relatively recent period of time. For example, the current state metric data 122 may indicate a level of activity of the user 102 over the last five minutes. In another implementation, the current state metric data 122 may be with respect to a previous occurrence or event. For example, the current state metric data 122 may indicate the average number of processor cycles used by the computing device 104(1) since a last input received from the user 102.

The profile module 124 is configured to generate profile data 126 which is indicative of a level of user 102 activity over a period of time, sequence of operations, and so forth. The profile module 124 may use one or more of the operational data 114, the environmental data 116, or the state metric data 122 to generate profile data 126. For example, the profile module 124 may use state metric data 122 which provides information about a span of time to build a time series which indicates the level of activity over time. The level of activity may be of the user 102, the service devices 110, or combination thereof. For example, profile data 126 may be generated for one of the service devices 110, indicating that the level of activity associated with that service has increased or decreased over time. In another example, profile data 126 may be generated for the user 102, such as indicating when the user 102 is very inactive such as sleeping, active such as while working, or very active such as while exercising. In some implementations, the profile data 126 may comprise an aggregate or combination of the activity levels of the user 102 and the service devices 110. The profile data 126 may incorporate a hysteresis function, such that the output is dependent at least in part on a previous input. The hysteresis function may prevent the profile data 126 from high-amplitude changes in value due to transient or "spike" events. For example, the profile data 126 may be processed to smooth out effects such as a user 102 jumping up from a chair or a service device 110 switching on and then off quickly.

The profile module 124 may be used to generate baseline profile data 126. The baseline profile data 126 provides a reference against which an individual level of activity may be compared to categorize the level of activity. For example, baseline profile data 126(1) for a user 102(1) who works from home may allow for the level of activity corresponding to the user 102(1) sitting at a desk and drafting a document on the computing device 104(1), 104(2), . . . , 104(D) as being "active". In comparison, another user 102(2) who is an athlete may perform the same actions, but due to a different baseline profile data 126(2) may be designated as being "sedentary".

The profile module 124 may use data from a plurality of facilities, users 102, or both to generate a standardized or initial baseline profile data 126. For example, users 102 may be sorted according to one or more common demographics such as age, place of residence, occupation, and so forth, and the operational data 114 and environmental data 116 from these users 102 may be combined and used to build baseline profile data 126. The profile data 126 is described below in more detail with regard to FIG. 4.

In one implementation, the profile data 126 may be expressed as a time series such as scores over time. In another implementation, the profile data 126 may be expressed as scores with respect to specific events or conditions. For example, the profile data 126 may be expressed as a score contemporaneous with activation of the computing device 104(1) to present content 108. In other implementations, the profile data 126 may be expressed using other data structures or formats.

The operation control module 128 may be configured to analyze the state metric data 122, the profile data 126, or a combination thereof to determine one or more operations to be performed. In some implementations, this analysis may include determining ratios using the state metric data 122. For example, a ratio of an environmental score to an operational score may be determined which indicates typical activity of the user 102 and the service devices 110 providing services to the user 102. Should anomalous activity take place, the ratio may deviate from a particular value. For example, where the operational score is very high and the environmental score is very low, the low ratio resulting from this may be indicative of anomalous activity. Continuing the example, while the user 102 sleeps and is deemed inactive, a malicious process such as a botnet may be using the computing device 104(1) extensively for unauthorized activities.

Based at least in part on the analysis, the operation control module 128 may generate instructions, issue commands, or otherwise affect operation of the service devices 110 to perform, or modify performance of, one or more operations. For example, the operation control module 128 may generate instructions which direct the router computing device 104(3) (not shown) which provides routing services on the network 106 to block traffic sent by the television computing device 104(1) which is exhibiting anomalous activity while the user 102 is sleeping.

In another example, the operation control module 128 may determine that the user 102 is inactive and may initiate operations such as a data backup transferring large quantities of data by way of the network 106 to a remote computing device 104(4) (not shown). Likewise, the operation control module 128 may determine that the user 102 is active while working late one night and may suspend operations, such as terminating the data backup or de-prioritizing it to a lower level. As a result, contention for resources between the user 102 and processes is reduced or eliminated.

In addition to, or instead of, providing direction to the service devices 110, in some implementations the operation control module 128 may provide a service. For example, the operation control module 128 may determine that the activity level of the user 102 has dropped below a threshold value as compared to the baseline profile data 126. In this example, the operation control module 128 may issue a command to prompt the user 102 to indicate that they are fine. Should the user 102 fail to respond to this prompt, the operation control module 128 may issue commands to summon assistance, such as emergency medical services.

The system 100 may thus coordinate the activities of service devices 110 and the associated services to better operate in harmony with the activity of the user 102. As a result, service delivery may be improved, the user experience may be improved, and other benefits may accrue.

Figure 2:
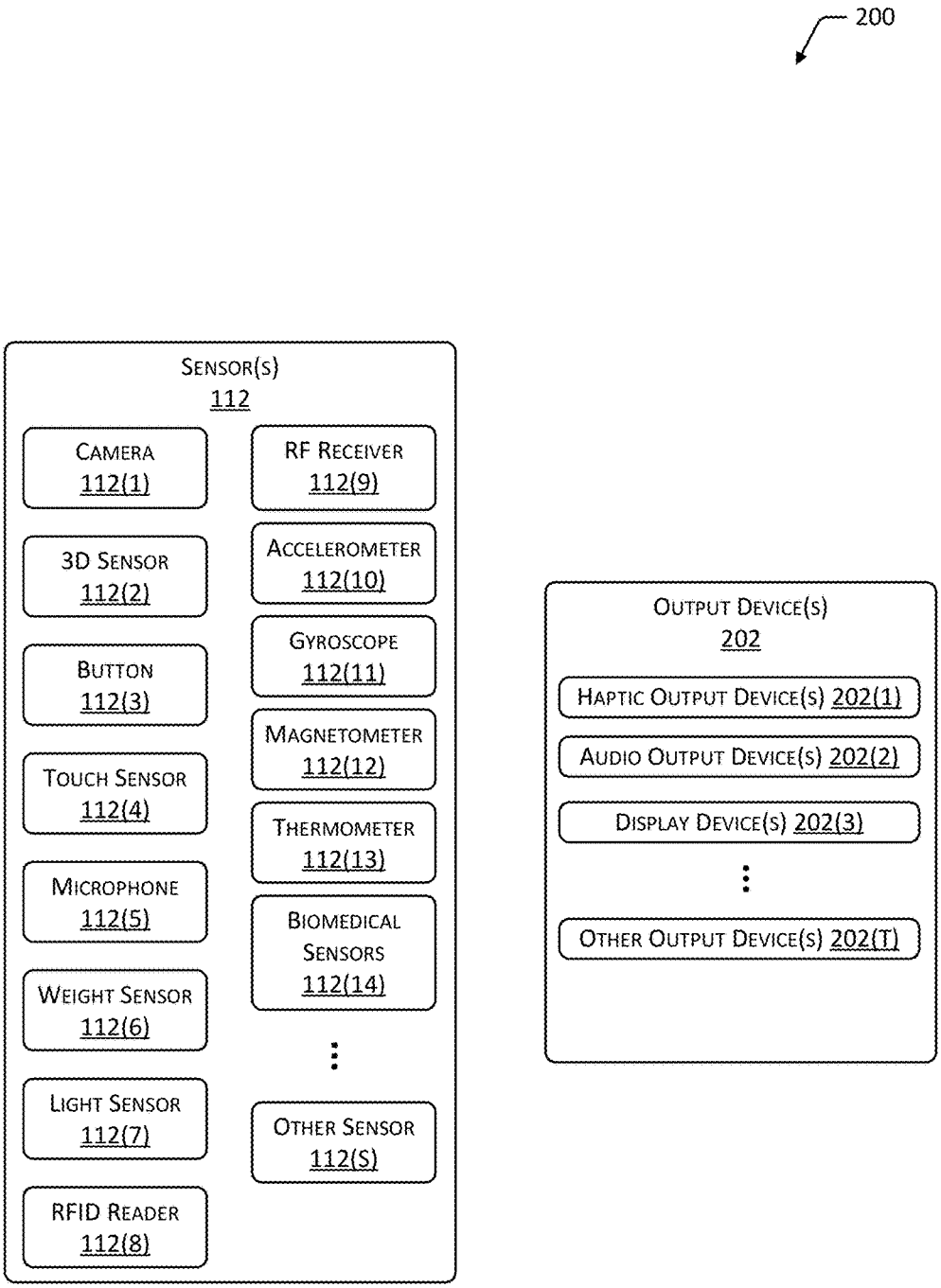
FIG. 2 illustrates a block diagram of sensors and output devices that may be used by the system during operation.

FIG. 2 illustrates a block diagram 200 of sensors 112 and output devices 202 that may be used by the system 100 during operation. As described above, the sensors 112 may generate environmental data 116, which may then be provided to the data acquisition module 118.

The one or more sensors 112 may be arranged at one or more locations within the facility. For example, the sensors 112 may be mounted on or within a floor, wall, a ceiling, may be carried or worn by the user 102, embedded in furnishings, and so forth.

The sensors 112 may include one or more cameras 112(1). These cameras 112(1) may include imaging sensors configured to acquire images of a scene. The imaging sensors are configured to detect light in one or more wavelengths including, but not limited to, terahertz, infrared, visible, ultraviolet, and so forth. The imaging sensors may comprise charge coupled devices (CCD), complementary metal oxide semiconductor (CMOS) devices, microbolometers, and so forth. The metric generator module 120 may use image data acquired by the cameras 112(1) during operation of the facility. For example, the metric generator module 120 may identify the user 102, determine how much the user 102 is moving, determine whether the user's 102 eyes are open or closed, and so forth based at least in part on their appearance within the image data acquired by the cameras 112(1).

One or more 3D sensors 112(2) may also be included in the sensors 112. The 3D sensors 112(2) are configured to acquire spatial or three-dimensional data, such as distance, 3D coordinates, point cloud, and so forth about objects within a sensor field-of-view. The 3D sensors 112(2) may include range cameras, lidar systems, sonar systems, radar systems, structured light systems, stereo vision systems, optical interferometry systems, and so forth.

The metric generator module 120 may use the three-dimensional data acquired by the 3D sensors 112(2) to determine a pose of the user 102, determine motion of the user 102, and so forth. For example, the 3D data may indicate that the user 102 is posed in a supine position on a couch.

One or more buttons 112(3) are configured to accept input from the user 102. The buttons 112(3) may comprise mechanical, capacitive, optical, or other mechanisms. For example, the buttons 112(3) may comprise mechanical switches configured to accept an applied force from a touch of the user 102 to generate an input signal. The metric generator module 120 may use data from the buttons 112(3) to determine the activity level of the user 102. For example, the state metric data 122 may generate an operational score based on a number of keystrokes per minute entered by the user 102.

The sensors 112 may include one or more touch sensors 112(4). The touch sensors 112(4) may use resistive, capacitive, surface capacitance, projected capacitance, mutual capacitance, optical, Interpolating Force-Sensitive Resistance (IFSR), or other mechanisms to determine the position of a touch or near-touch. For example, the IFSR may comprise a material configured to change electrical resistance responsive to an applied force. The location within the material of that change in electrical resistance may indicate the position of the touch. The metric generator module 120 may use data from the touch sensors 112(4) to determine activity level of the user 102. For example, the state metric data 122 may generate an operational score based on a number of touches per second.

One or more microphones 112(5) may be configured to acquire information indicative of sound present in the environment. In some implementations, arrays of microphones 112(5) may be used. These arrays may implement beamforming techniques to provide for directionality of gain. The metric generator module 120 may use the one or more microphones 112(5) to acquire audio data that may be indicative of a level of activity of the user 102, the service devices 110, or both. For example, the audio data may be used to determine a current noise level, and categorize one or more of the sounds which have been detected. Continuing the example, the metric generator module 120 may generate an environmental score indicative of a high noise level and sounds associated with a celebration.

One or more weight or pressure sensors 112(6) are configured to measure the weight of a load, such as the user 102 or other objects such as furniture. The weight sensors 112(6) may be incorporated into the flooring of the facility, into furnishings such as couches or chairs, and so forth. The weight sensors 112(6) may include one or more sensing mechanisms to determine the weight of a load. These sensing mechanisms may include piezoresistive devices, piezoelectric devices, capacitive devices, electromagnetic devices, optical devices, potentiometric devices, microelectromechanical devices, and so forth. The sensing mechanisms of the weight sensors 112(6) may operate as transducers that generate one or more signals based on an applied force, such as that of the load due to gravity. The metric generator module 120 may use the data acquired by the weight sensors 112(6) to generate an environmental score. For example, output from the weight sensors 112(6) underneath the user 102 while sitting may vary as the user 102 shifts, resulting in a first environmental score. Continuing the example, as the user 102 falls asleep and becomes quiescent, the extent of the shifting may decrease resulting in a corresponding decrease in the output, resulting in a second environmental score which is lower than the first. The operation control module 128 may use this difference to determine that the user 102 has become inactive.

The sensors 112 may include one or more light sensors 112(7). The light sensors 112(7) may be configured to provide information associated with ambient lighting conditions such as a level of illumination. The data acquisition module 118 may provide environmental data 116 about the level of illumination to the metric generator module 120. For example, information about the level of illumination may be used to generate the profile data 126.

One or more radio frequency identification (RFID) readers 112(8), near field communication (NFC) systems, and so forth, may also be included as sensors 112. The user 102 of the facility may be equipped with one or more radio frequency (RF) tags. The RF tags are configured to emit an RF signal. In one implementation, the RF tag may be a radio frequency identification (RFID) tag configured to emit the RF signal upon activation by an external signal. For example, the external signal may comprise a radio frequency signal or a magnetic field configured to energize or activate the RFID tag. In another implementation, the RF tag may comprise a transmitter and a power source configured to power the transmitter. For example, the RF tag may comprise a Bluetooth® Low Energy (BLE) transmitter and battery. In other implementations, the tag may use other techniques to indicate presence of the tag. For example, an acoustic tag may be configured to generate an ultrasonic signal which is detected by corresponding acoustic receivers. In yet another implementation, the tag may be configured to emit an optical signal.

The data acquisition module 118 may be configured to use the RF tags for one or more of identification of the user 102, determining a location of the user 102, determining a motion of the user 102, and so forth. For example, RF tags may be embedded within the clothing of the user 102 and may be read by the RFID readers 112(8).

One or more RF receivers 112(9) may also be included as sensors 112. In some implementations, the RF receivers 112(9) may be part of transceiver assemblies. The RF receivers 112(9) may be configured to acquire RF signals associated with Wi-Fi®, Bluetooth®, ZigBee®, 3G, 4G, LTE, or other wireless data transmission technologies. The RF receivers 112(9) may provide information associated with data transmitted via radio frequencies, signal strength of RF signals, and so forth. For example, information from the RF receivers 112(9) may be used by the metric generator module 120 to determine an operational score indicative of the amount of wireless traffic associated with the computing device 104(1), 104(2), . . . , 104(D) of the user 102, such as a smart phone or tablet.

The sensors 112 may include one or more accelerometers 112(10), which may be worn or carried by the user 102, or affixed to furnishings, and so forth. The accelerometers 112(10) may provide information such as the direction and magnitude of an imposed acceleration. Data such as rate of acceleration, determination of changes in direction, speed, and so forth, may be determined using the accelerometers 112(10). For example, the user 102 may wear a device having one or more accelerometers 112(10), and the environmental data 116 resulting therefrom may be used to generate an environmental score corresponding to a level of physical activity of the user 102.

A gyroscope 112(11) provides information indicative of rotation of an object affixed thereto. For example, the device worn by the user 102 as described above may incorporate a gyroscope 112(11).

A magnetometer 112(12) may be used to determine an orientation by measuring ambient magnetic fields, such as the terrestrial magnetic field. The magnetometer 112(12) may be worn or carried by the user 102. For example, the device worn by the user 102 as described above may incorporate a magnetometer 112(12).

A thermometer 112(13) may provide information indicative of a temperature of an object. For example, a thermometer 112(13) may be incorporated into the device worn by the user 102 as described above. The thermometer 112(13) in this device may be configured to measure ambient air temperature proximate to the user 102, or the body temperature of the user 102. In one implementation, the profile module 124 may use the environmental data 116 indicative of temperature from the thermometer 112(13). For example, the profile module 124 may designate periods experiencing lower physical activity by the user 102 as indicated from the accelerometer 112(10) and lower ambient air temperature is indicated by the thermometer 112(13) as being periods of inactivity by the user 102.

One or more biomedical sensors 112(14) are configured to acquire information about the physical state of the user 102 and their associated physiology. For example, the biomedical sensors 112(14) may be configured to measure one or more of brain waves, muscle activity, pulse, respiration, galvanic skin response, pupillary dilation, and so forth. Continuing the example, a biomedical sensor 112(14) which detects eye motion may provide environmental data 116 to the profile module 124 to provide input for generation of the profile data 126.

The sensors 112 may include other sensors 112(5) as well. For example, the other sensors 112(5) may include proximity sensors, barometric sensors, hygrometers, biometric input devices, and so forth.

In some implementations, the sensors 112 may include hardware processors, memory, and other elements configured to perform various functions. Furthermore, the sensors 112 may be configured to communicate by way of the network 106.

Output devices 202 may also be provided in the facility, or by the devices therein. The output devices 202 are configured to generate signals which may be perceived by the user 102, detectable by the sensors 112, or a combination thereof.

Haptic output devices 202(1) are configured to provide a signal which results in a tactile sensation to the user 102. The haptic output devices 202(1) may use one or more mechanisms such as electrical stimulation or mechanical displacement to provide the signal. For example, the haptic output devices 202(1) may be configured to generate a modulated electrical signal which produces an apparent tactile sensation in one or more fingers of the user 102. In another example, the haptic output devices 202(1) may comprise piezoelectric or rotary motor devices configured to provide a vibration which may be felt by the user 102.

One or more audio output devices 202(2) are configured to provide acoustic output. The acoustic output includes one or more of infrasonic sound, audible sound, or ultrasonic sound. The audio output devices 202(2) may use one or more mechanisms to generate the acoustic output. These mechanisms may include, but are not limited to: voice coils, piezoelectric elements, magnetorestrictive elements, electrostatic elements, and so forth. For example, a piezoelectric buzzer or a speaker may be used to provide acoustic output.

The display devices 202(3) may be configured to provide output which may be seen by the user 102, or detected by a light-sensitive detector such as a camera 112(1) or light sensor 112(7). The output may be monochrome or color. The display devices 202(3) may be emissive, reflective, or both. An emissive display device 202(3), such as using LEDs, is configured to emit light during operation. In comparison, a reflective display device 202(3), such as using an electrophoretic element, relies on ambient light to present an image. Backlights or front lights may be used to illuminate non-emissive display devices 202(3) to provide visibility of the output in conditions where the ambient light levels are low.

The display mechanisms may include, but are not limited to, micro-electromechanical systems (MEMS), spatial light modulators, electroluminescent displays, quantum dot displays, liquid crystal on silicon (LCOS) displays, cholesteric displays, interferometric displays, liquid crystal displays, electrophoretic displays, and so forth. These mechanisms are configured to emit light, modulate incident light emitted from another source, or both. The display devices 202(3) may operate as panels, projectors, and so forth.

The display devices 202(3) may be configured to present images. For example, the display devices 202(3) may comprise a pixel-addressable display. The image may comprise at least a two-dimensional array of pixels, or a vector representation of an at least two-dimensional image.

In some implementations, the display devices 202(3) may be configured to provide non-image data, such as text characters, colors, and so forth. For example, a segmented electrophoretic display device 202(3), segmented LED, and so forth, may be used to present information such as letters or numbers. The display devices 202(3) may also be configurable to vary the color of the segment, such as using multicolor LED segments.

In some implementations, display devices 202(3) may be configurable to provide image or non-image output. For example, an electrophoretic display device 202(3) with addressable pixels may be used to present images of text information, or all of the pixels may be set to a solid color such as in a first state which is all black or a second state which is all white.

Other output devices 202(T) may also be present. For example, the other output devices 202(T) may include scent/odor dispensers, document printers, three-dimensional printers, and so forth.

Figure 3:
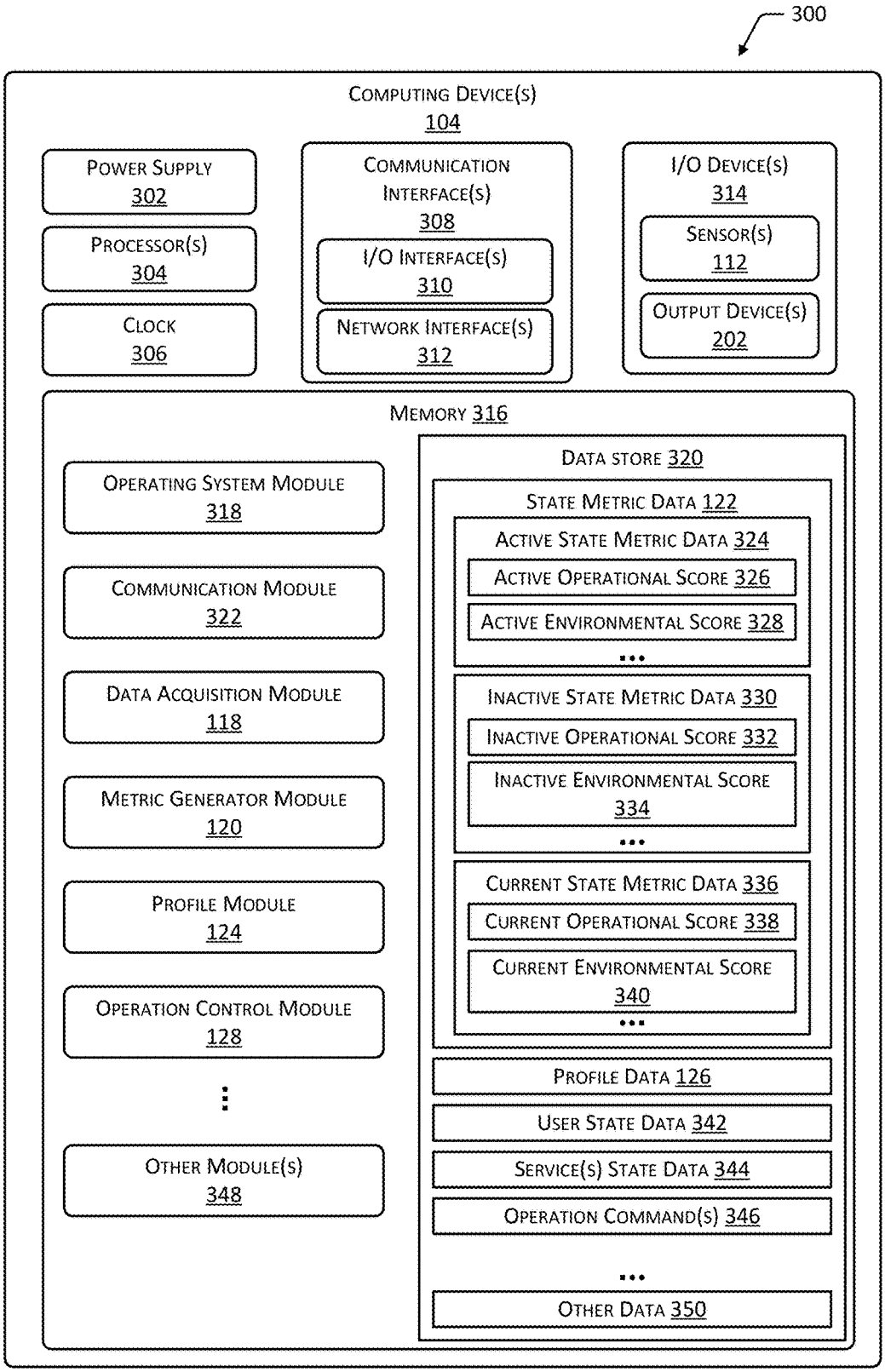
FIG. 3 illustrates a block diagram of a computing device configured to support operation of the system.

FIG. 3 illustrates a block diagram 300 of a computing device 104 configured to support operation of the system 100. The computing device 104 may be physically present at the facility, may be accessible by the network 106, or a combination of both.

In some implementations, the computing device 104 may not require end-user knowledge of the physical location and configuration of the system that delivers the services. For example, the server computing devices 104(2) may be described using expressions including "on-demand computing", "software as a service (SaaS)", "platform computing", "network-accessible platform", "cloud services", "data centers", and so forth. Services provided by the computing device 104 may be distributed across one or more physical or virtual devices.

One or more power supplies 302 are configured to provide electrical power suitable for operating the components in the computing device 104. The computing device 104 may include one or more hardware processors 304 (processors) configured to execute one or more stored instructions. The processors 304 may comprise one or more cores. One or more clocks 306 may provide information indicative of date, time, ticks, and so forth. For example, the processor 304 may use data from the clock 306 to generate a timestamp, trigger a preprogrammed action, and so forth.

The computing device 104 may include one or more communication interfaces 308 such as I/O interfaces 310, network interfaces 312, and so forth. The communication interfaces 308 enable the computing device 104, or components thereof, to communicate with other devices or components. The communication interfaces 308 may include one or more I/O interfaces 310. The I/O interfaces 310 may comprise interfaces such as Inter-Integrated Circuit (I2C), Serial Peripheral Interface bus (SPI), Universal Serial Bus (USB) as promulgated by the USB Implementers Forum, RS-232, and so forth.

The I/O interface(s) 310 may couple to one or more I/O devices 314. The I/O devices 314 may include input devices such as one or more of a sensor 112, keyboard, mouse, scanner, and so forth. The I/O devices 314 may also include output devices 202 such as one or more of a display, printer, audio speakers, and so forth. In some embodiments, the I/O devices 314 may be physically incorporated with the computing device 104 or may be externally placed.

The network interfaces 312 are configured to provide communications between the computing device 104 and other devices, such as the sensors 112, routers, access points, other computing devices 104, and so forth. The network interfaces 312 may include devices configured to couple to PANs, LANs, WANs, and so forth. For example, the network interfaces 312 may include devices compatible with Ethernet, Wi-Fi®, Bluetooth®, ZigBee®, 3G, 4G, LTE, and so forth.

The computing device 104 may also include one or more busses or other internal communications hardware or software that allow for the transfer of data between the various modules and components of the computing device 104.

As shown in FIG. 3, the computing device 104 includes one or more memories 316. The memory 316 comprises one or more computer-readable storage media (CRSM). The CRSM may be any one or more of an electronic storage medium, a magnetic storage medium, an optical storage medium, a quantum storage medium, a mechanical computer storage medium, and so forth. The memory 316 provides storage of computer-readable instructions, data structures, program modules, and other data for the operation of the computing device 104. A few example functional modules are shown stored in the memory 316, although the same functionality may alternatively be implemented in hardware, firmware, or as a system on a chip (SOC).

The memory 316 may include at least one operating system (OS) module 318. The OS module 318 is configured to manage hardware resource devices such as the I/O interfaces 310, the network interfaces 312, the I/O devices 314, and provide various services to applications or modules executing on the processors 304. The OS module 318 may implement a variant of the FreeBSD™ operating system as promulgated by the FreeBSD Project, other UNIX™ or UNIX-like variants, a variation of the Linux™ operating system as promulgated by Linus Torvalds, the Windows® operating system from Microsoft Corporation of Redmond, Wash., or other operating system.

Also stored in the memory 316 may be a data store 320 and one or more of the following modules. These modules may be executed as foreground applications, background tasks, daemons, and so forth. The data store 320 may use a flat file, database, linked list, tree, executable code, script, or other data structure to store information. In some implementations, the data store 320 or a portion of the data store 320 may be distributed across one or more other devices including the computing devices 104, network attached storage devices, and so forth.

A communication module 322 may be configured to establish communications with one or more of other computing devices 104, the sensors 112, the service devices 110, or other devices. The communications may be authenticated, encrypted, and so forth.

The memory 316 may store the data acquisition module 118, the metric generator module 120, the profile module 124, or the operation control module 128. As described above, the data acquisition module 118 is configured to acquire one or more of operational data 114, or environmental data 116 from service devices 110 and sensors 112 respectively.

In some implementations, the data acquisition module 118 may perform some processing of the data. For example, the data acquisition module 118 may perform object recognition to identify an object appearing in image data from the camera sensors 112(1). Continuing the example, facial recognition may be performed to identify a particular user 102. Facial characteristics, such as measurements ratios between different features or fiducials on the user's 102 face, may comprise a set of eigenvectors generated by using principal component analysis (PCA) on the image of the user 102. These eigenvectors as descriptive of a human face may be known as "eigenfaces" or "eigenimages". In one implementation, identification may be performed at least in part using one or more tools available in the OpenCV library as developed by Intel Corporation of Santa Clara, Calif., Willow Garage of Menlo Park, Calif., and Itseez of Nizhny Novgorod, Russia, with information available at www.opencv.org. The identification may include comparing eigenvectors of the images with those previously stored, such as those acquired during a registration process of the user 102, to determine identity of the user 102.

The metric generator module 120 is configured to generate the state metric data 122 which may be stored in the data store 320. The state metric data 122 may include active state metric data 324 which provides information corresponding to an active state of the user 102, one or more service devices 110, or both. The active state metric data 324 may include an active operational score 326 and an active environmental score 328. The active operational score 326 may comprise a value calculated from one or more pieces of the operational data 114 from the one or more service devices 110. The active environmental score 328 may comprise a value calculated from one or more pieces of the environmental data 116 from the one or more sensors 112. In some implementations, the active state metric data 324 may comprise a combination or aggregation of the active operational score 326 and the active environmental score 328. For example, different weighting factors may be used to multiply against the active operational score 326 and the active environmental score 328, with the products summed to generate the active state metric data 324.

In some implementations, the active state metric data 324 may be based on historical or previously acquired data. Based on this historical data, an active state metric data 324 may be generated and used to set a threshold or range of scores which are indicative of an active state.

The state metric data 122 may include inactive state metric data 330 which provides information corresponding to an inactive state of the user 102, one or more service devices 110, or both. The inactive state metric data 330 may include an inactive operational score 332 and an inactive environmental score 334. The inactive operational score 332 may comprise a value calculated from one or more pieces of the operational data 114 from the one or more service devices 110. The inactive environmental score 334 may comprise a value calculated from one or more pieces of the environmental data 116 from the one or more sensors 112. In some implementations, the inactive state metric data 330 may comprise a combination or aggregation of the inactive operational score 332 and the inactive environmental score 334. For example, different weighting factors may be used to multiply against the inactive operational score 332 and the inactive environmental score 334, with the products summed to generate the inactive state metrics 330.

In some implementations, the inactive state metric data 330 may be based on historical or previously acquired data. Based on this historical data, an inactive state metric data 330 may be generated and used to set a threshold or range of scores which are indicative of an inactive state.

In one implementation, the state metric data 122 may comprise an operational score and an environmental score such as those described above, with the determination as to the corresponding level of activity being based at least in part on those scores. In this implementation, the determination as to whether the state metric data 122 corresponds to an active or inactive state on the part of the user 102 or the service devices 110 may be based at least in part on the sum of the scores, time of day, or other factors. For example, an operational score and an environmental score may be generated for data encompassing a five-minute span of time. These two scores may be summed to form state metric data 122, which is then compared against a threshold value to determine whether the state metric data 122 is indicative of an active state or an inactive state.

The state metric data 122 may include current state metric data 336 which provides information corresponding to a current state of the user 102, one or more service devices 110, or both. The current state may be defined in terms of an event or a span of time. For example, the current state may comprise information acquired since an occurrence of an event such as the user 102 entering a room. In another example, the current state may comprise a span of time such as the previous five minutes. The current state metric data 336 may include a current operational score 338 and a current environmental score 340. The current operational score 338 may comprise a value calculated from one or more pieces of the operational data 114 from the one or more service devices 110. The current environmental score 340 may comprise a value calculated from one or more pieces of the environmental data 116 from the one or more sensors 112. Similar to that described above, the current state metric data 336 may comprise a combination or aggregation of the current operational score 338 and the current environmental score 340.

The operation control module 128 may use the state metric data 122 to generate user state data 342, service state data 344, or both. The user state data 342 comprises an indication of a level of activity of the user 102, such as at the current time. Similarly, the service state data 344 comprises an indication of level of activity of one or more of the services. The user state data 342, the service state data 344, or both may be expressed in terms of a binary value, flag, probability, or value indicative of a position within a continuum of activity. For example, the user state data 342 may be expressed as an eight bit value indicative of one of 256 possible activity levels. In some implementations, a confidence interval or probability indicative of an estimate of reliability may also be included.

The operation control module 128 may use the user state data 342, the service state data 344, or both to determine one or more operations to perform. Once determined, the operation control module 128 may generate one or more operation commands 346. The operation commands 346 may comprise one or more instructions or commands configured to initiate or otherwise elicit a particular operation upon a receiving device. For example, the operation control module 128 may determine user state data 342 indicating the user 102 is inactive and service state data 344 for a network attached storage computing device 104 is also inactive. Based on the inactivity of both the user 102 and the computing device 104 which is a service device 110, the operation control module 128 may generate operation commands 346 to the computing device 104 to begin backing up data to a remote computing device 104 by way of the network 106.

In another example, the operation commands 346 may comprise one or more instructions to present an advertisement, or other promotional information by way of the one or more output devices 202 to the user 102. Continuing the example, once the user 102 is determined to be active such as upon awakening, an advertisement for a particular breakfast cereal may be presented on the television computing device 104(1).

In another implementation, the operation control module 128 may use state metric data 122 to determine one or more operations to perform. For example, the operation control module 128 may compare the current state metric data 336 with historically based active state metric data 324 and inactive state metric data 330. By way of this comparison, the current state metric data 336 may be used to determine the current state of the user 102, the service devices 110, or both. For example, should the current state metric data 336 indicate an aggregate score which is within a range specified by the active state metric data 324, the current activity of the user 102 may be determined to be active.

As described above, the profile module 124 is configured to generate profile data 126 which is indicative of a level of user 102 activity over a period of time, sequence of operations, and so forth. The profile module 124 to be used to generate profile data 126 indicative of a baseline. The baseline profile data 126 provides a reference against which an individual level of activity may be compared to categorize the level of activity. The profile module 124 may use data from a plurality of facilities, users 102, or both to generate a standardized or initial baseline profile data 126. The profile data 126 is described below in more detail with regard to FIG. 4.

Other modules 348 may also be present in the memory 316, as well as other data 350 in the data store 320. For example, the other modules 348 may include an audio characterization module configured to characterize audio as speech, laughter, celebration, and so forth. The other data 350 may include user identification data, account information, and so forth.

Figure 4:
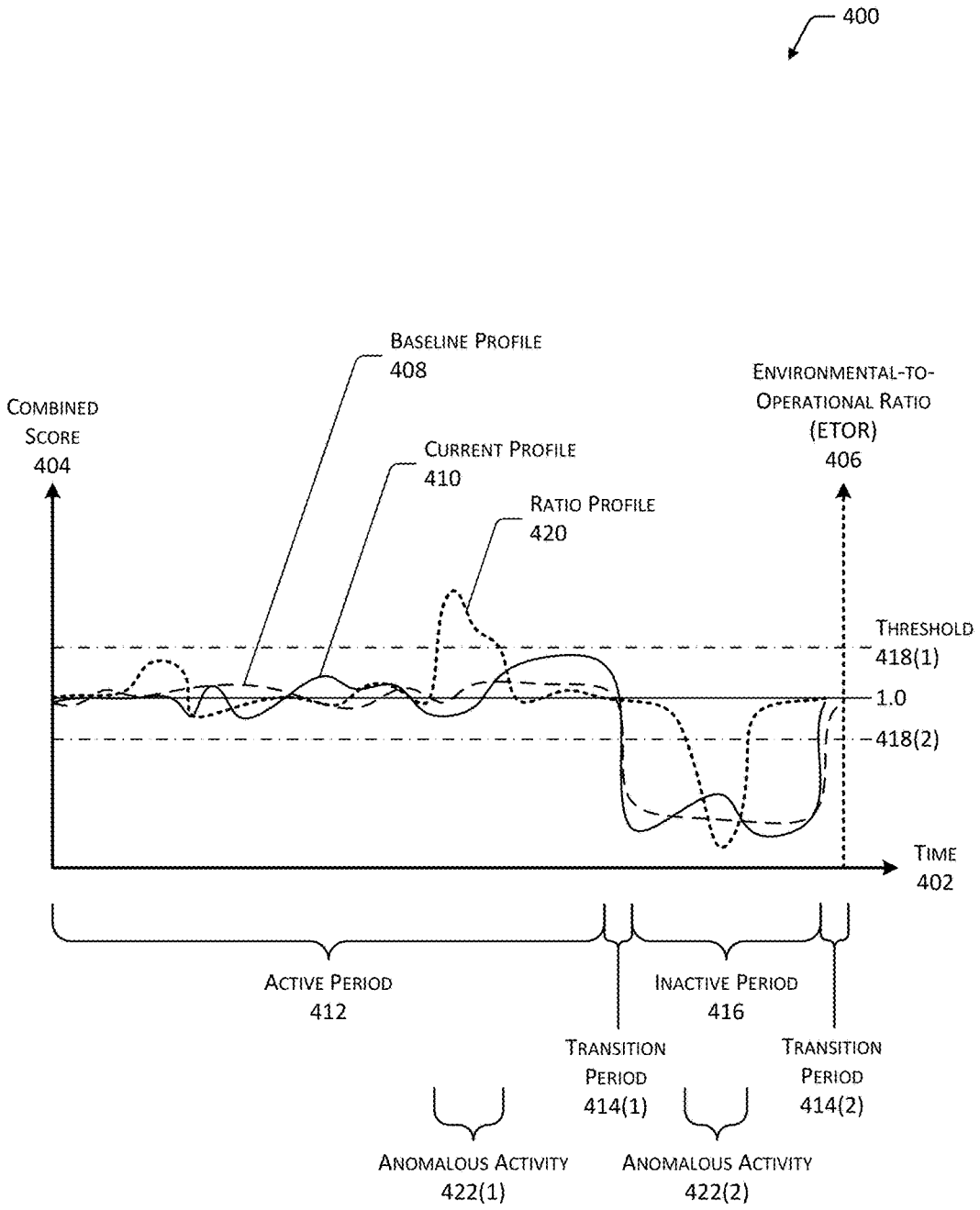
FIG. 4 is an illustrative graph depicting activity profiles and ratios which may be used to determine active periods, inactive periods, and anomalous activity.

FIG. 4 is an illustrative graph 400 depicting profiles and ratios derived from one or more of operational data 114, environmental data 116, or other data. In some implementations, the profile data 126 may be visualized as the profiles depicted here. The profile data 126 may be used to determine active periods, inactive periods, anomalous activity, and so forth.

The graph 400 includes a time 402 axis extending horizontally across the page and a perpendicular combined score 404 axis extending vertically from the time 402 axis. Also, depicted perpendicular to the time 402 axis is an environmental-to-operational ratio 406 (ETOR). As described above, the profile data 126 may be described as a time series of data (such as shown here), or as values with respect to specific events or conditions. The combined score 404 may comprise a combination or aggregate of the state metric data 122, such as a sum of the operational score and the environmental score for a particular points in time.

The profile data 126, and the resultant profiles generated therefrom may be indicative of variations associated with particular periods or sequences. For example, the profiles may reflect different scenarios, such as weekday, weekend, holiday, seasonal variation, and so forth.

A baseline profile 408 is depicted which shows how the combined score 404 varies over time. As described above, a hysteresis function may be used to generate the baseline profile 408. For example, the baseline profile 408 may comprise active state metric data 324 and inactive state metric data 330 derived from historical data. As described above, in some implementations the baseline profile 408 may be specific to a user 102, or may be based on information acquired from a plurality of users 102. In comparison, a current profile 410 is indicative of the current state, such as provided by the current state metric data 336. As described above, a hysteresis function may be used to generate the current profile 410.

Several periods are indicated in this graph 400 including an active period 412, transition periods 414(1) and 414(2), and an inactive period 416. Also depicted are an upper threshold 418(1) and a lower threshold 418(2). For ease of illustration and not by way of limitation, the threshold 418 may provide different thresholds for the combined score 404 of the profiles as compared to the ETOR 406.

In some implementations, the determination as to whether the user 102, the service device 110, or both are active or inactive may be based on comparison with a predetermined threshold value, or a change in value which exceeds a threshold percentage. For example, state metric data 122 which has a combined score 404 which the lower threshold 418(2) may be deemed indicative of activity, while scores below this value may be deemed indicative of inactivity. Where the baseline profile 408 or the current profile 410 exceeds the lower threshold 418(2), the active period 412 is designated. In some implementations, the baseline profile 408 may be used to determine a level of the lower threshold 418(2). For example, the lower threshold 418(2) may be determined by applying one or more statistical techniques to the profile data 126 which is represented by the baseline profile 408. Also depicted is a transition period 414 where the profiles represent a change between an active state and an inactive state.

The data which is represented by the ETOR 406 may be generated by the profile module 124 or another module of the system 100. A ratio profile 420 is presented here which is indicative of the ratio relative to a central value of 1.0 as indicated on the graph 400. For example, the current environmental score 340 may be divided by the current operational score 338 to generate the ETOR 406. In some implementations, other techniques such as data normalization or application of weights may be used as well. In this illustration, it is assumed that the use of the services by the user 102 as indicated by the current operational score 338 is directly proportionate to the level of activity of the user as indicated by the environmental score. For example, while the user 102 is awake and active they may be using the services of the service device 110, but while the user 102 is asleep and inactive the use of the service device 110 ceases.

By analyzing the ETOR 406 ratio, anomalous activity 422 may be detected. In some situations the anomalous activity 422 may be innocuous, while in other situations the anomalous activity 422 may be suspicious or malicious. In this illustration, the ratio profile 420 exists primarily between an upper threshold 418(1) and the lower threshold 418(2). Where the ratio profile 420 (or corresponding ETOR 406) exceeds one of the thresholds 418, and anomalous activity 422 may be deemed to occur. For example, an anomalous activity 422(1) is illustrated in which the ratio profile 420 exceeds the upper threshold 418(1). This situation may be obtained where the user's 102 physical activity has increased to a level which is disproportionately high relative to the services consumed. Continuing the example, the user 102 may be vigorously exercising in a dimly lit room, thus the environmental score indicative of the user's 102 activity exceeds the operational score associated with the service of providing illumination by a home automation system.

Continuing the illustration, the second anomalous activity 422(2) is illustrated in which the ratio profile 420 is below the lower threshold 418(2). This situation may be obtained where the level of services being consumed is disproportionately high relative to the activity level of the user 102. For example, the user 102 may be asleep but a malicious process executing on the television computing device 104(1) may be consuming a significant amount of processor resources and bandwidth on the network 106.

By analyzing the profiles as described herein, the operation control module 128 may perform one or more actions. For example, during the first anomalous activity 422(1) the operation control module 128 may issue operation commands 346 to increase the level of illumination in the room which the user 102 is occupied. In another example, during the second anomalous activity 422(2) operation commands 346 may be issued which instruct the computing device 104(1) to terminate the anomalous process, shutdown, restrict access to the network 106, and so forth.

Figure 5:
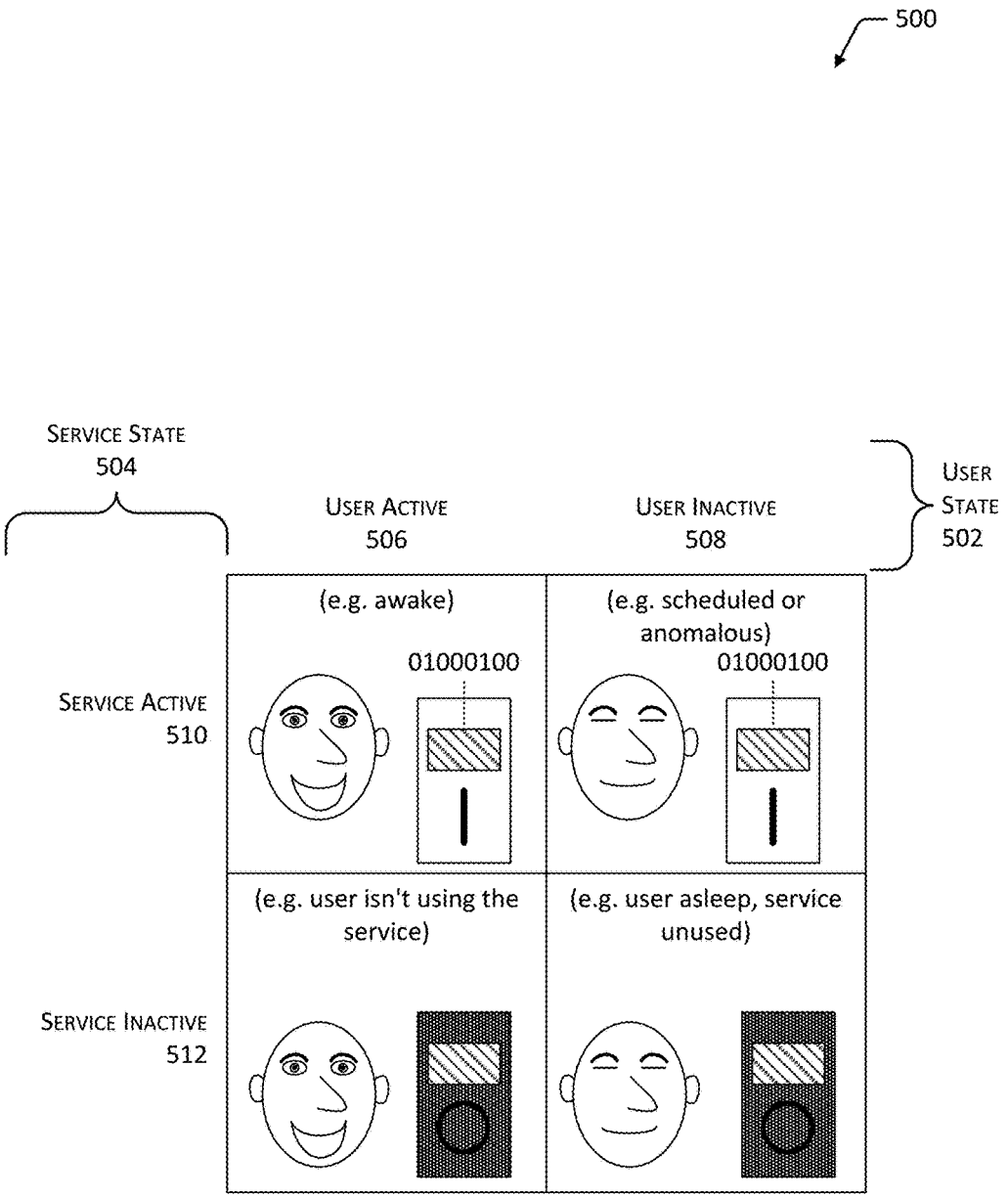
FIG. 5 illustrates different user states and service states and possible activities associated therewith.

FIG. 5 illustrates a chart 500 of different user states, service states, and possible activities associated therewith. In this chart, user state 502 (such as stored in the user state data 342) is represented along one axis, while service state 504 (such as stored in the service state data 344) is represented along a perpendicular axis.

The user state 502 and the service state 504 are depicted in this chart as binary values, having either one state or another, for ease of illustration and not necessarily as a limitation. These states may exist in a continuum extending from one extreme to another. For example, the user state 502 may be torpid, or the service state 504 may be quiescent standby.

The user state 502 in this example may include a user active 506 or a user inactive 508. For example, the user active 506 may correspond to the user being awake and moving around, while the user inactive 508 may correspond to the user being at rest. The service state 504 in this example may include a service active 510 or a service inactive 512. For example, the service state active 510 may correspond to the computing device 104(1) presenting content 108 while the service state inactive 512 may correspond to the computing device 104(1) entering a standby mode.

When the conditions are such that the user active 506 and the service inactive 512 obtain, the operation control module 128 may generate operation commands 346 to activate the service device 110 to provide a service to the user 102. For example, the computing device 104(1) may begin presenting content 108 such as soft background music.

When the conditions are such that the user inactive 508 and the service inactive 512 obtain, the operation control module 128 may generate operation commands 346 to provide a service which does not involve the user 102, such as indexing files or backing up data across the network 106. In some implementations, an alert may be issued that is indicative of a potential malfunction of the service. For example, the baseline profile 408 may indicate that the particular service is always active, at least partially. Thus, a situation in which the user 102 is inactive and the service is inactive may be of particular interest.

When the conditions are such that the user inactive 508 and the service active 510 obtain, the operation control module 128 may compare the activity of the service device 110 to determine if the activity is approved or unapproved. For example, the target address of data being sent using the network 106 by the computing device 104(1) may be compared with previously recorded data, a whitelist, or a blacklist to determine if unauthorized communication is taking place. Should the activity be of an unknown or undesirable nature, operation commands 346 may be issued to perform one or more operations such as initiating verbose logging, restricting access to the network 106, terminating the process performing activity, and so forth.

Figure 6:
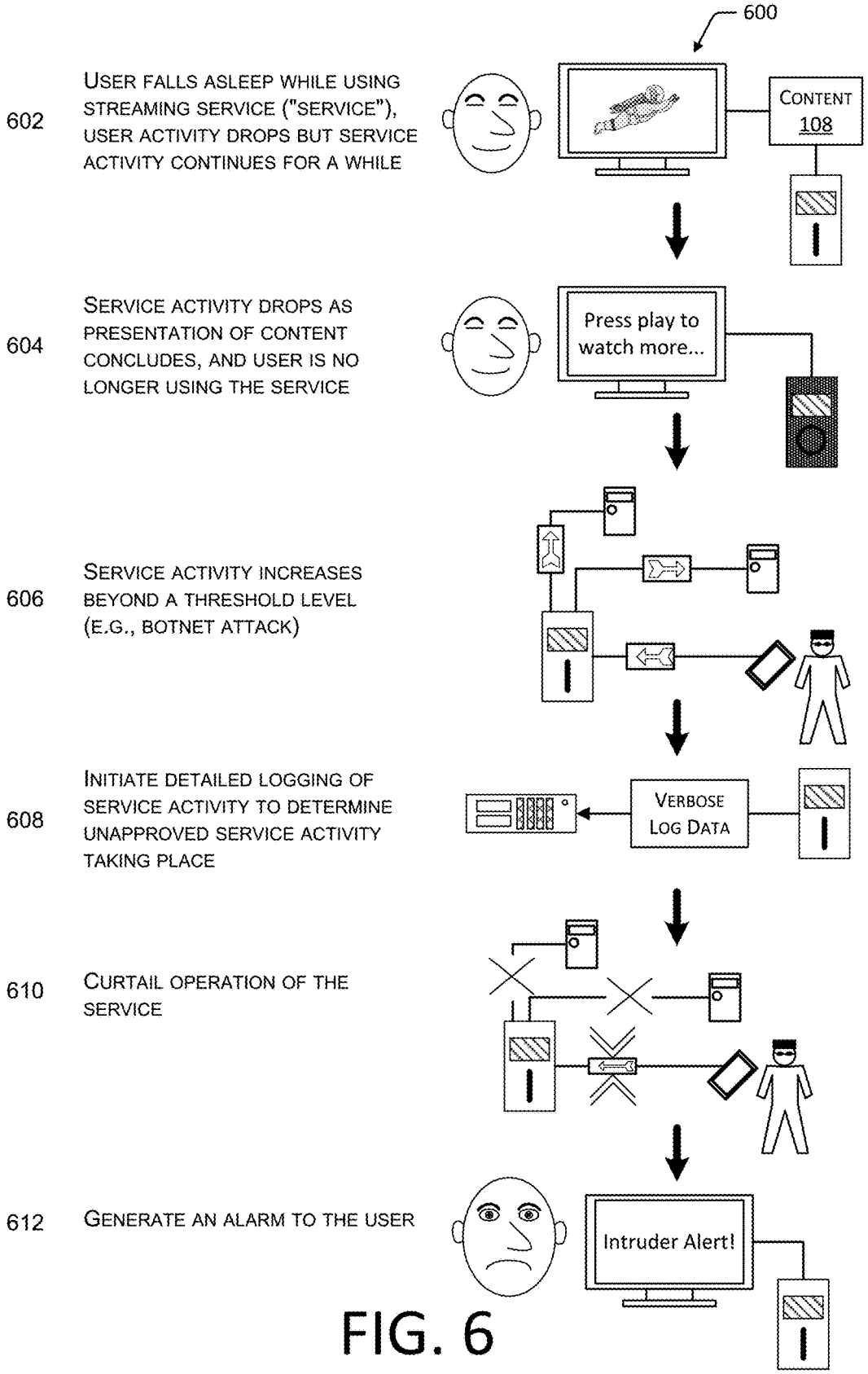
FIG. 6 illustrates a scenario in which the user is determined to be inactive while the service is determined to be unusually active as a result of malicious activity.

FIG. 6 illustrates a scenario 600 in which the user 102 is determined to be inactive while the service is determined to be unusually active as a result of malicious activity.

At 602 the user 102 has fallen asleep while using a streaming service which delivers content 108 from a remote computing device 104(3) to the local television computing device 104(1). As a result of falling asleep, the activity level of the user 102 has dropped and has been designated as inactive.

At 604 the service activity drops as the streaming and presentation of content 108 concludes, and the user 102 is no longer using the service.

At 606, while the user 102 sleeps, the service activity increases beyond a threshold level. For example, a botnet attack or other malicious process may be executing on, or attacking, the television computing device 104(1), resulting in an increase in the usage of processor resources, memory, bandwidth on the network 106, input output operations, and so forth. As a result, the activity of the service may deviate from previously generated profile data 126 such as the baseline profile 408. A deviation in the ETOR ratio 406 may also occur as a result of the unusually high level of activity of the computing device 104(1) while the user 102 is inactive.

At 608, the operation control module 128 determines that anomalous activity 422 may be taking place and generates operation commands 346 to perform one or more operations. For example, the operations may include initiating detailed logging of service activity on the television computing device 104(1) to determine if unapproved service activities are taking place. For example, the detailed logging may include information indicative of target addresses of data being sent by the service using the network 106, stack dump information, debug data, and so forth.

At 610, the operation commands 346 take effect on one or more of the service devices 110. For example, the television computing device 104(1) may be instructed to terminate program processes executing thereon, the router computing device 104(3) may be directed to temporarily deny connectivity to the television computing device 104(1), and so forth. As a result of the operation of the system 100 described herein, suspicious activity which may have gone unnoticed while the user 102 slept has been detected and remedial actions taken.

Illustrative Processes

Figure 7:
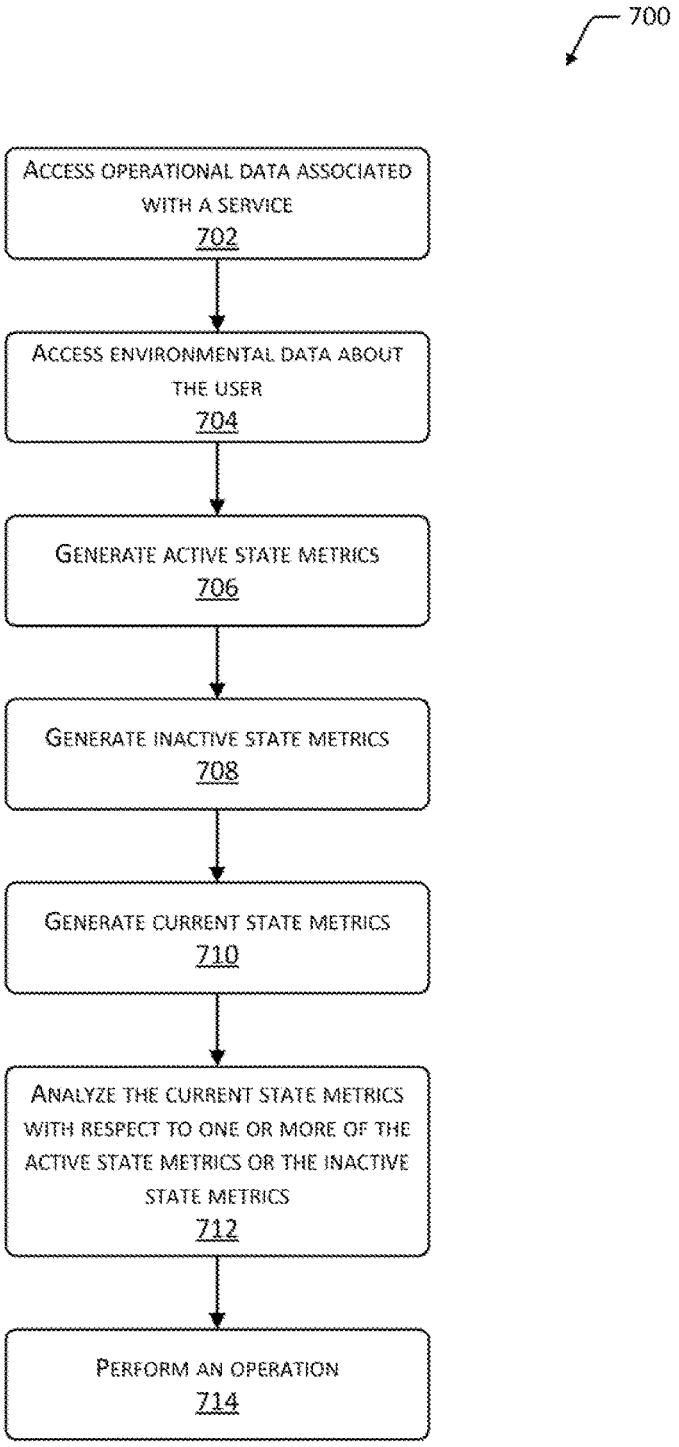
FIG. 7 illustrates a flow diagram of a process to determine activity and perform an operation responsive thereto.

FIG. 7 illustrates a flow diagram 700 of a process to determine activity and perform an operation responsive thereto. In some implementations, the process may be performed at least in part by one or more of the data acquisition module 118, the metric generator module 120, the profile module 124, or the operation control module 128.

Block 702 accesses the operational data 114. As described above, the operational data 114 provides information indicative of one or more of the service devices 110 which provide one or more services to, on behalf, or otherwise for the benefit of the user 102.

Block 704 accesses the environmental data 116. As described above, the environment data 116 may be acquired by one or more the sensors 112.

Block 706 generates active state metric data 324 indicative of an active state of the user 102. The active state metric data 324 may comprise one or more of: an active operational score 326 based at least in part on historical operational data 114, or an active environmental score 328 based at least in part on historical environmental data 116.

Block 708 generates inactive state metric data 330 indicative of an inactive state of the user 102. The inactive state metric data 330 may comprise one or more of: an inactive operational score 332 based at least in part on the historical operational data 114, or an inactive environmental score 334 based at least in part on the historical environmental data 116.

Block 710 generates current state metric data 336 indicative of a current state of the user 102. The current state metric data 336 may comprise one or more of: a current operational score 338 based at least in part on current operational data 114, or a current environmental score 340 based at least in part on current environmental data 116.

Block 712 analyzes the current state metric data 336 with respect to one or more of the active state metric data 324 or the inactive state metric data 330. In one implementation, the analysis may comprise a numeric comparison between the data, to determine whether the current state metric data 336 falls within ranges specified by the active state metric data 324 or the inactive state metric data 330.

Based on the analysis, block 714 performs one or more operations. The one or more operations may include generation of one or more operation commands 346 and distributing those operation commands 346 to one or more of the service devices 110.

The operations may include one or more of disabling an executing application or process, dropping an active network connection, reducing throughput of the active network connection, initiating a data backup, initiating multi-factor authentication of the user 102, deactivating a payment account, generating an alert or other notification, and so forth. For example, upon determining that a potentially anomalous activity 422(2) is taking place, the operation control module 128 may issue operation commands 346 requiring other computing devices 104 which are affiliated with the user 102 or the computing device 104(1) which may be compromised to require multifactor authentication of the user 102 before providing services. Continuing this example, the service devices 110 may now be locked down preventing or containing a breach of data security. A payment account or service provider such as a credit card company or electronic payment clearinghouse may receive notification and as a result may also implement multifactor or additional authentication steps for accounts associated with the user 102 or the potentially compromised computing device 104. The multifactor authentication may include entry of the username and password, answering a challenge question, providing biometric input, performing an unlock procedure, providing a physical token, and so forth.

The operation commands 346 issued by the operation control module 128 may affect services such as physical delivery of goods or utilities. For example, after determining a change in the user state 502 and service state 504 relative to the baseline profile 408, an order for goods may be generated, modified, or canceled. Continuing the example, after determining that the user 102 has been very active for an extended period of time an order quantity for goods such as soft drinks may be increased proportionate to the increase in activity. In another example, a complete lack of activity such as where the user 102 is not present at their dwelling may result in a modification of the order to change a delivery date of the goods. Once the user 102 arrives home, the order may be modified to initiate immediate delivery. The order may be modified to change a shipping type for delivery of the goods based at least in part on the changes in the user state 502 and the service state 504. For example, should the overall activity level of the user 102 decrease and the quantity of water used in the dwelling decrease, a shipping type of overnight delivery for a water filter may be changed to a three day delivery. As a result, the user 102 may benefit from reducing the shipping cost associated with the water filter.

The operation commands 346 issued by the operation control module 128 may affect services such as electronic delivery of content 108. For example, the environmental data 116 may be indicative of a plurality of users 102 present in a single location. Continuing the example, a celebration may be in progress in which several users 102 are present around the television computing device 104(1). The owner of the dwelling in which the celebration is taking place may wish to prevent inadvertent charges from accruing on their account associated with providing content 108 which may occur as guests order content 108 for consumption. The operation commands 346 may be configured to require additional authentication steps prior to delivery of the content 108 when multiple users 102 are present. Upon receiving approval from the authorized user 102 associated with the account, the content 108 may be delivered. For instance, the authorized user 102 may be required to enter a password or fingerprint before the content 108 will be billed to the account and streamed to a television computing device 104(1).

In one implementation, the state metric data 122 such as the environmental score may provide information indicative of a level of physical activity and a pose of the user 102. For example, the current environmental score 340 may indicate that the level of physical activity is low and pose of the user 102 is supine on a couch.

In this implementation, the operational data 114 may be used to determine an operational score indicative of a level of activity of the service provided by the service device 110. For example, the current operational score 338 may indicate that the service device 110 is operating at maximum capacity.

Continuing implementation, the ETOR ratio 406 between the environmental score and the operational score may be calculated. The analysis of block 714 may then include a comparison of a current ratio of the current state metric data 336 and one or more of: an active ratio of the active state metric data 324, or an inactive ratio of the inactive state metric data 330.

Figure 8:
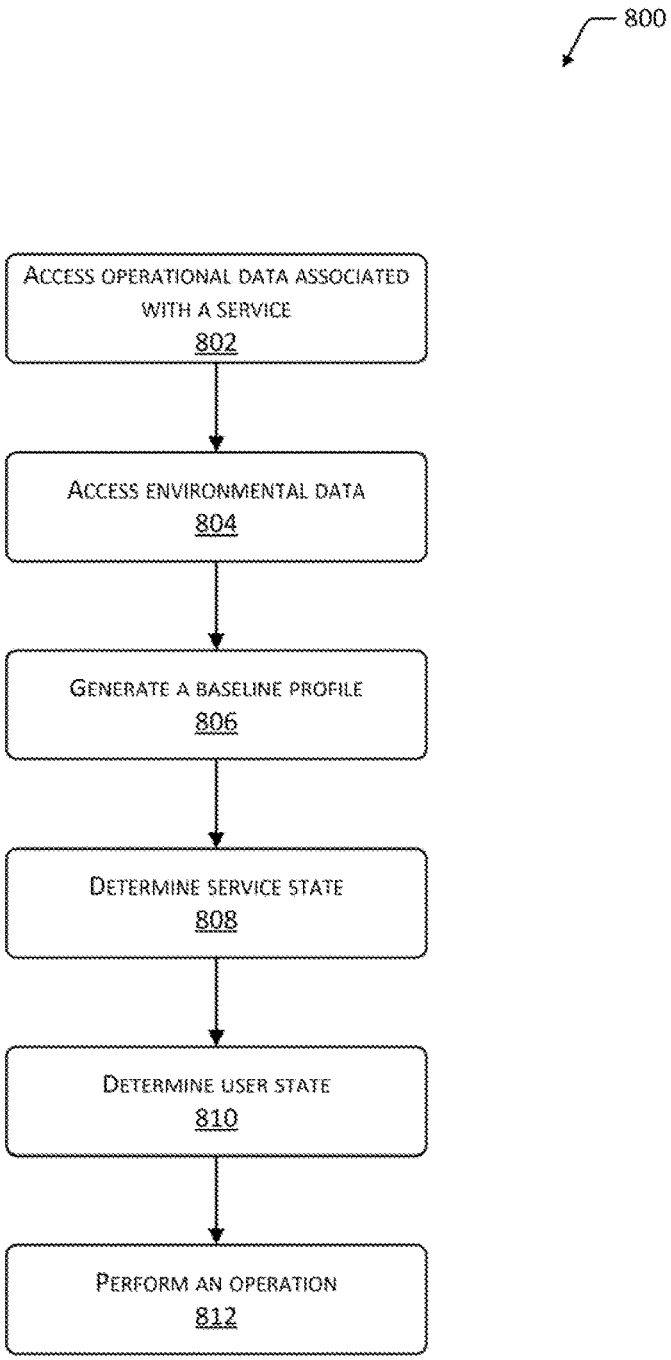
FIG. 8 illustrates a flow diagram of a process to perform an operation based on a baseline profile of activity.

FIG. 8 illustrates a flow diagram 800 of a process to perform an operation based on the baseline profile 408 of activity. In some implementations, the process may be performed at least in part by one or more of the data acquisition module 118, the metric generator module 120, the profile module 124, or the operation control module 128.

Block 802 accesses operational data 114 indicative of one or more services provided by one or more service devices 110.

Block 804 accesses environmental data 116 indicative of one or more users 102.

Block 806 generates baseline profile data 126, such as described above. For example, baseline profile data 126 may be generated using historical operational data 114 and historical environmental data 116. As described above with regard to FIG. 4, the baseline profile data 126 may indicate one or more active periods 412 and one or more inactive periods 416. Other periods such as transition periods 414 may also be indicated.

The determination of the level of activity of the user 102 is based at least in part on a comparison of current environmental data 116 (such as the current environmental score 340) and current operational data 114 (such as the current operational score 338) with the baseline profile data 126. The determination of the level of activity of the user 102 may include both the environmental data 116 and the operational data 114 to allow for consideration of user 102 activities which may be more mental, such as writing a document, compared to more physical activities such as exercise.

The determination of the level of activity of the service provided by the service device 110 is based at least in part on a comparison of the current operational data 114 (such as the current operational score 338) with the baseline profile data 126.

Block 808 determines service state data 344 indicative of a level of activity of the one or more services or the service devices 110. The service state data 344 may provide information indicative of the level of activity of an individual service, or for an aggregate of all the services. As described above, the level of activity of the service may be indicative of, or based at least in part on, use of the service by the user 102.

The service may be associated with the user 102. The association between the service and the user 102 may be based at least in part on one or more of: user 102 presence at a physical location such as the facility or a portion thereof, recognition of the user 102, user 102 login, or billing responsibility by the user 102 for the service. For example, the user 102 who logs into the television computing device 104(1) and requests content 108 for presentation is associated with the service of presenting the content 108.

Block 810 determines user state data 342 indicative of a level of activity of the one or more users 102. The user state data 342 may provide information indicative of the level of activity for individual users 102, or for an aggregate of all the users 102. As described above, the level of activity of the user 102 may be indicative of, or based at least in part on, the physical activity of the user 102.

Block 812 performs one or more operations based at least in part on one or more of the service state data 344 or the user state data 342. In some implementations, the one or more operations may comprise generating operation commands 346 and providing the operation commands 346 to one or more of the service devices 110 which provide the one or more services.

In one example, the determination of the level of activity of the service may be based on a comparison with a threshold value. Based on the level of activity such as quantified with a score exceeding the threshold, the service may be deemed active. Such as described above with regard to FIG. 6, when the user 102 is determined to be inactive and the service state 504 is determined to be active, and anomalous activity 422 such as malicious activity may be deemed to occur. The one or more operations may comprise generating operation commands 346 configured to generate an alert of potentially malicious activity. The alert may be distributed to the user 102 or another agency such as a server computing device 104(2).

Figure 9:
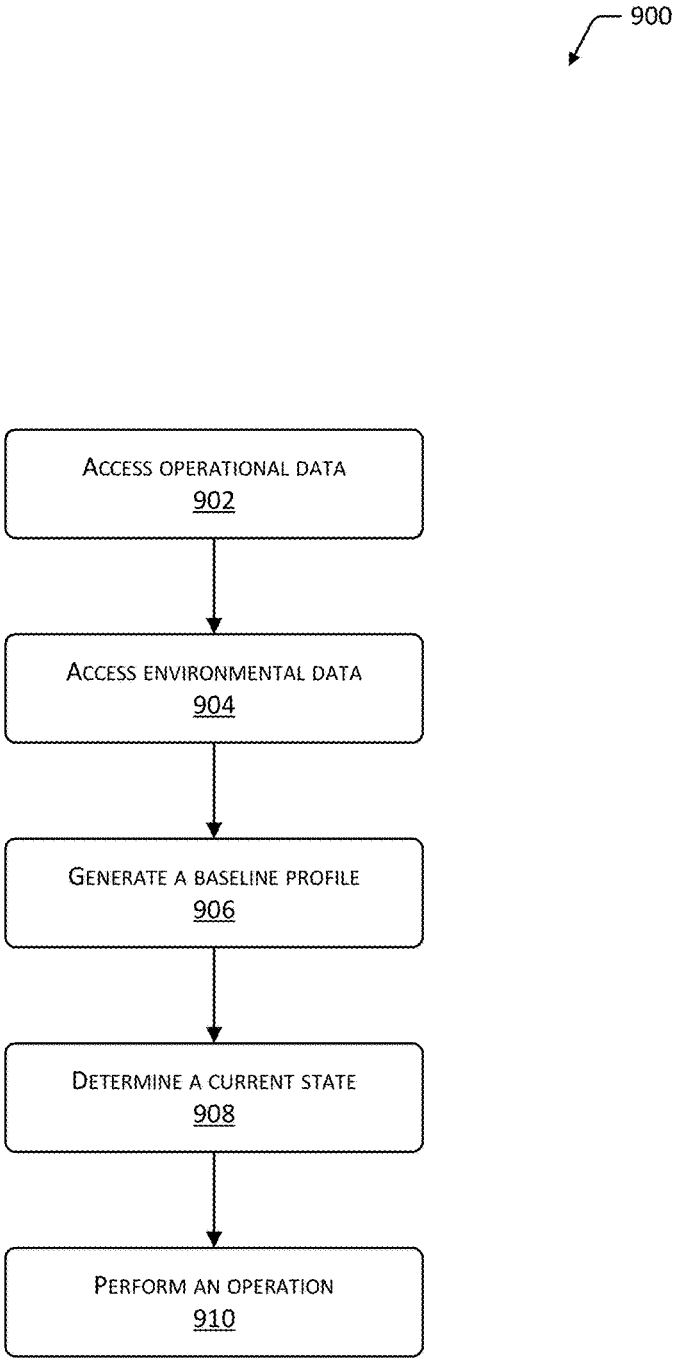
FIG. 9 illustrates a flow diagram of a process to determine a current state and the service state and perform an operation responsive thereto.

FIG. 9 illustrates a flow diagram 900 of a process to determine a current state and the service state and perform an operation responsive thereto. In some implementations, the process may be performed at least in part by one or more of the data acquisition module 118, the metric generator module 120, the profile module 124, or the operation control module 128.

Block 902 accesses the operational data 114. As described above, the operational data 114 may be indicative of one or more services used at a location. The location may comprise a single facility, a portion of the facility such as a particular room within the facility, or a furnishing within the facility.

Block 904 accesses environmental data 116. As described above, the environmental data 116 may be indicative of one or more users 102 at the location.

Block 906 generates the baseline profile 408. As described above, generation of the baseline profile data 126 may be based at least in part on historical environmental data 116 and historical operational data 114. The baseline profile 408 may indicate one or more of an active period 412 or an inactive period 416.

Block 908 determines a current state indicative of activity of at least a portion of the one or more users 102. For example, the current state may indicate that one of the users 102(1) is active such as working late while another user 102(2) is inactive such as sleeping.

Where the baseline profile data 126 is available, the determination of the current state may include a comparison of the baseline profile data 126 to current state metric data 336. As described above, the current state metric data 336 may be based on a current operational score 338 and a current environmental score 340.

Block 910 performs one or more operations based on the current state. For example, upon the determination that the current state indicates that one or more users 102 are inactive, the operation control module 128 may generate one or more operation commands 346 to initiate transfer of data using the network 106. The transfer of data may comprise a backup of data to the remote computing device 104(4), retrieval of data for pre-caching, and so forth.

In a first example, the current state may be indicative of the one or more users 102 resting and use of the one or more services may be above a threshold level. The one or more operations may comprise issuing operation commands 346 to generate an alarm or other notification indicative of unusual activity by the one or more services.

In a second example, a block (not shown) may count a number of the one or more users 102 and determine the count exceeds a threshold value. The current state may be indicative of the one or more users 102 performing one or more actions with an intensity above a threshold value. Responsive to this set of conditions, block 910 may perform one or more operations to restrict access to at least a portion of the one or more services. Continuing the example, a password may be required to access paid content 108 when more than three users 102 are awake and present near the television computing device 104(1).

In a third example, a block (not shown) may determine a count of the one or more users 102 based at least in part on one or more of the environmental data 116 or the operational data 114. Continuing the example, the count may be determined based on a count of the number of faces present in an image acquired by the camera 112(1), count of unique RF tags detected by the RFID reader112(8), and so forth.

Operational data 114 may write information indicative of the count, such as a number of rooms in which lights are active, patterns of door or window openings and closings, and so forth.

The processes discussed herein may be implemented in hardware, software, or a combination thereof. In the context of software, the described operations represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. Those having ordinary skill in the art will readily recognize that certain steps or operations illustrated in the figures above may be eliminated, combined, or performed in an alternate order. Any steps or operations may be performed serially or in parallel. Furthermore, the order in which the operations are described is not intended to be construed as a limitation.

Embodiments may be provided as a software program or computer program product including a non-transitory computer-readable storage medium having stored thereon instructions (in compressed or uncompressed form) that may be used to program a computer (or other electronic device) to perform processes or methods described herein. The computer-readable storage medium may be one or more of an electronic storage medium, a magnetic storage medium, an optical storage medium, a quantum storage medium, and so forth. For example, the computer-readable storage media may include, but is not limited to, hard drives, floppy diskettes, optical disks, read-only memories (ROMs), random access memories (RAMs), erasable programmable ROMs (EPROMs), electrically erasable programmable ROMs (EEPROMs), flash memory, magnetic or optical cards, solid-state memory devices, or other types of physical media suitable for storing electronic instructions. Further, embodiments may also be provided as a computer program product including a transitory machine-readable signal (in compressed or uncompressed form). Examples of transitory machine-readable signals, whether modulated using a carrier or unmodulated, include but are not limited to signals that a computer system or machine hosting or running a computer program can be configured to access, including signals transferred by one or more networks. For example, the transitory machine-readable signal may comprise transmission of software by the Internet.

Separate instances of these programs can be executed on or distributed across any number of separate computer systems. Thus, although certain steps have been described as being performed by certain devices, software programs, processes, or entities, this need not be the case and a variety of alternative implementations will be understood by those having ordinary skill in the art.

Additionally, those having ordinary skill in the art readily recognize that the techniques described above can be utilized in a variety of devices, environments, and situations. Although the subject matter has been described in language specific to structural features or methodological acts, it is to be understood that the subject matter defined in the appended claims is not necessarily limited to the specific features or acts described. Rather, the specific features and acts are disclosed as exemplary forms of implementing the claims.

What is claimed is:

1. A system comprising:

a sensor configured to generate environmental data indicative of one or more of: a presence of a user, a pose of a user, or an activity of a user;

a communication interface in communication with the sensor and a device, wherein the device is configured to:

provide a service associated with the user, and generate operational data indicative of performance of the service;

a memory, storing computer-executable instructions; and a hardware processor in communication with the communication interface, and the memory, wherein the hardware processor is configured to execute the computer-executable instructions to:

access the operational data;

access the environmental data;

generate active state metrics indicative of an active state of the user, the active state metrics comprising:

an active operational score based at least in part on historical operational data;

an active environmental score based at least in part on historical environmental data; and generate inactive state metrics indicative of an inactive state of the user, the inactive state metrics comprising:

an inactive operational score based at least in part on the historical operational data;

an inactive environmental score based at least in part on the historical environmental data; and generate current state metrics indicative of a current state of the user, the current state metrics comprising:

a current operational score based at least in part on current operational data;

a current environmental score based at least in part on current environmental data;

analyze the current state metrics with respect to one or more of the active state metrics or the inactive state metrics; and based on the analysis, perform an operation.

2. The system of claim 1, the generation of one or more of the active state metrics, the inactive state metrics, or the current state metrics further comprising computer-executable instructions to:

use the environmental data to determine an environmental score indicative of a level of physical activity and the pose of the user;

use the operational data to determine an operational score indicative of a level of activity of the service; and calculate a ratio between the environmental score and the operational score; and the analysis comprising instructions to:

compare a current ratio of the current state metrics and one or more of: an active ratio of the active state metrics, or an inactive ratio of the inactive state metrics.

3. The system of claim 1, wherein the operation comprises one or more computer-executable instructions to:

disable an executing application, drop an active network connection, reduce throughput of the active network connection, initiate a data backup, initiate multi-factor authentication of the user, or generate an alert.

4. The system of claim 1, wherein:
the pose of the user is indicative of one or more of:
standing,
sitting,
lying down,
eyes open, or
eyes closed,
the sensor comprises one or more of:
a camera,
a microphone,
an accelerometer associated with the user, or
a biomedical sensor;
the service associated with the user comprises one or more of:
processing data,
transferring data on a network,
controlling an appliance, or
providing electrical power; and
the activity of the user comprises one or more of:
the user moving about,
the user speaking, or
the user performing one or more tasks with a computing device.

5. A method comprising:
accessing operational data indicative of a service, wherein the service is associated with a user based at least in part on one or more of:
user presence at a physical location,
recognition of the user,
user login, or
billing responsibility by the user for the service;
accessing environmental data indicative of the user;
determining a service state indicative of a level of activity of the service;
determining a user state indicative of a level of activity of the user based at least in part on a comparison of current environmental data and current operational data with a baseline profile; and
performing one or more operations based at least in part on the service state and the user state.

6. The method of claim 5, wherein the level of activity of the user is indicative of physical activity of the user and the level of activity of the service is indicative of use of the service by the user.

7. The method of claim 5, wherein the one or more operations comprise sending one or more operation commands to initiate multi-factor authentication of the user.

8. The method of claim 5, wherein:
the environment data is further indicative of one or more of:
presence of the user,
pose of the user,
activity of the user, or
count of users; and
the operational data is indicative of one or more of:
type of the service,
type of device providing the service,
start time of use of the service,
duration of use of the service,
data transfer rate, or
number of processor cycles used.

9. The method of claim 5, further comprising:
generating the baseline profile using historical operational data and historical environmental data, wherein the baseline profile indicates an active period and an inactive period; and
wherein
determining the level of activity of the service is based at least in part on a comparison of the current operational data with the baseline profile.

10. The method of claim 5, further comprising:
determining the level of activity of the service exceeds a threshold value; and
wherein:
the user is determined to be inactive and the service state is determined to be active, and
the one or more operations include generating an alert indicative of potentially malicious activity.

11. The method of claim 5, the one or more operations comprising:
disabling an executing application,
dropping an active network connection,
reducing throughput of the active network connection,
initiating a transfer of data across a wide area network to a remote device,
deactivating a payment account, or
generating an alert.

12. The method of claim 5, the one or more operations comprising:
determining a change in the user state and the service state relative to the baseline profile; and
modifying an order for goods, the modifying comprising one or more of:
changing an order quantity of the goods,
changing a delivery date of the goods, or
changing a shipping type for delivery of the goods.

13. The method of claim 5, wherein:
the environmental data is indicative of a plurality of users present at a single location;
the service is configured to present, at a user device, content delivered by way of a network; and
the one or more operations comprising:
receiving approval from the user associated with the account prior to delivery of content.

14. The method of claim 5, wherein the user state indicates the user is active, and the one or more operations comprise presenting one or more advertisements.

15. A system comprising:
a communication interface in communication with one or more devices;
a memory, storing computer-executable instructions; and
a hardware processor in communication with the communication interface and the memory, wherein the hardware processor is configured to execute the computer-executable instructions to:
access operational data indicative of one or more services used at a location;
access environmental data indicative of one or more users at the location;
determine a current state indicative of activity of at least a portion of the one or more users based on a comparison of a baseline profile to current state metrics, wherein the current state metrics are based on a current operational score and a current environmental score; and
perform one or more operations based on the current state.

16. The system of claim 15, wherein:
the current state indicates the one or more users are inactive; and
the one or more operations comprise initiation of transfer of data using a network.

17. The system of claim 15, wherein:

the current state is indicative of the one or more users resting and use of the one or more services is above a threshold level; and the one or more operations comprise generation of an alarm indicative of unusual activity by the one or more services.

18. The system of claim 15, wherein:

a count of the one or more users exceeds a threshold value;

the current state is indicative of the one or more users performing one or more actions with an intensity above a threshold value; and the one or more operations comprise restricting access to at least a portion of the one or more services.

19. The system of claim 15, further comprising computer executable instructions to generate the baseline profile based on historical environment data and historical operational data; wherein the baseline profile indicates one or more of an active period or an inactive period.

20. The system of claim 15, further comprising computer-executable instructions to:

determine a count of the one or more users based at least in part on one or more of the environmental data or the operational data; and wherein the one or more operations is further based on the count.

* * * * *